US011499567B2

(12) United States Patent
Wang

(10) Patent No.: US 11,499,567 B2
(45) Date of Patent: Nov. 15, 2022

(54) MULTIPURPOSE TRANSFER PUMP FREE OF SECONDARY WATER FILLING

(71) Applicant: GP Enterprises Co., Ltd., Jiangsu (CN)

(72) Inventor: Xian Wang, Jiangsu (CN)

(73) Assignee: GP Enterprises Co., Ltd., Suzhou (CN)

( * ) Notice: Subject to any disclaimer, the term of this patent is extended or adjusted under 35 U.S.C. 154(b) by 139 days.

(21) Appl. No.: 17/253,611

(22) PCT Filed: Jun. 8, 2020

(86) PCT No.: PCT/CN2020/094811

§ 371 (c)(1),
(2) Date: Dec. 17, 2020

(87) PCT Pub. No.: WO2021/109513

PCT Pub. Date: Jun. 10, 2021

(65) Prior Publication Data

US 2021/0372429 A1 Dec. 2, 2021

(30) Foreign Application Priority Data

Dec. 6, 2019 (CN) ..... 201922164973.X

(51) Int. Cl.
*F04D 29/40* (2006.01)
*F04D 13/02* (2006.01)
*F04D 29/08* (2006.01)

(52) U.S. Cl.
CPC ..... *F04D 29/406* (2013.01); *F04D 13/02* (2013.01); *F04D 29/086* (2013.01)

(58) Field of Classification Search
CPC ..... F04D 9/02; F04D 13/02; F04D 29/086; F04D 29/406; F04D 29/426
See application file for complete search history.

(56) References Cited

U.S. PATENT DOCUMENTS 7,537,439 B2 * 5/2009 Pohler ..... F04D 13/06 415/111
8,202,046 B2 * 6/2012 Buell ..... F04D 15/0083 415/196

(Continued)

FOREIGN PATENT DOCUMENTS

CN 208089559 U 11/2018
CN 208203582 U 12/2018

(Continued)

*Primary Examiner* — Richard A Edgar
*Assistant Examiner* — Jason G Davis

(57) ABSTRACT

The application discloses a multipurpose transfer pump free of secondary water filling, which comprises a cover plate, a water filling plug, a pump body, an impeller, a pump body flange and a motor, the pump body flange is provided at an end portion of the motor, the pump body is provided on a front surface of the pump body flange, a volute chamber corresponding to the impeller is provided in a back surface of the pump body in an inwards recessed manner. In this way, the multipurpose transfer pump free of secondary water filling disclosed by the application can achieve a self-priming effect without filling water into the pump body when the motor works for a second time, thus improving the impeller lubricating effect.

9 Claims, 3 Drawing Sheets

(56) References Cited

U.S. PATENT DOCUMENTS

| | | | | |
|---|---|---|---|---|
| 9,726,180 | B2 * | 8/2017 | Akiyama | F04D 9/02 |
| 9,903,388 | B2 * | 2/2018 | Tsuruda | F04D 9/02 |

FOREIGN PATENT DOCUMENTS

| | | | | |
|---|---|---|---|---|
| JP | S61126098 | U | * | 8/1986 |
| JP | H11294368 | A | * | 10/1999 |
| JP | 2003240125 | A | * | 8/2003 |
| JP | 2014190220 | A | * | 10/2014 |
| JP | 2014190292 | A | | 10/2014 |

* cited by examiner

MULTIPURPOSE TRANSFER PUMP FREE OF SECONDARY WATER FILLING

TECHNICAL FIELD

The application relates to the field of water pumps, in particular to a multipurpose transfer pump free of secondary water filling.

BACKGROUND ART

A general multipurpose transfer pump usually adopts a rubber impeller. A cavity in a pump body is in a cam structure. After water is filled into the pump body for lubrication, the rubber impeller rotates in an inner cavity, and flexible impeller blades will bend and deform. In the deformation process of the impeller blades in the inner cavity, a volume change will occur, thus water can be effectively and quickly sucked in and squeezed out to realize the self-priming process of a self-priming pump.

Since the rubber impeller has a bending service life, if the service life is exceeded, the impeller will be broken, resulting in the water pump not working. Each time the water pump works, water needs to be filled to lubricate the impeller. Otherwise, the impeller is easily overheated, such that damage is caused, the impeller needs to be replaced and it is troublesome to use. Therefore, it needs to be improved.

SUMMARY

The main technical problem to be solved by the application is to provide a multipurpose transfer pump free of secondary water filling, which avoids the problem of secondary water filling and improves the service life of the impeller.

In order to solve the technical problem, in one technical solution adopted by the application, a multipurpose transfer pump free of secondary water filling is provided, which includes a cover plate, a water filling plug, a pump body, an impeller, a pump body flange and a motor, the pump body flange is provided at an end portion of the motor, the pump body is provided on a front surface of the pump body flange, a volute chamber corresponding to the impeller is provided in a back surface of the pump body in an inwards recessed manner, the impeller is provided in the volute chamber and is concentrically fixed on a rotating shaft of the motor, a volute tongue part tangent to the impeller is provided at a top of the volute chamber, a liquid storage chamber enclosing the volute chamber and a gas-liquid separation chamber located above the liquid storage chamber are provided in a front surface of the pump body in an inwards recessed manner, a water inlet pipe joint and a water outlet pipe joint which extend obliquely and upwardly towards outer sides are provided on the two sides of a top of the pump body, two partition plates are provided in the gas-liquid separation chamber to form a water suction cavity communicated with the water inlet pipe joint and the volute chamber, a drainage outlet communicated with the gas-liquid separation chamber is provided in the volute chamber, the drainage outlet and the water suction cavity are located on the two sides of the volute tongue part, the cover plate is provided on the front surface of the pump body to seal the liquid storage chamber, the gas-liquid separation chamber and the water suction cavity, and the water filling plug is mounted on the pump body in a threaded manner.

In one exemplary embodiment of the application, the water inlet pipe joint and the water outlet pipe joint are distributed in a V-shaped angle.

In one exemplary embodiment of the application, a bearing mounting groove is provided in a front flange of the motor, a front bearing which is provided on the rotating shaft of the motor in a sleeving manner is provided in the bearing mounting groove, and a limiting pressure ring is provided behind the front bearing.

In one exemplary embodiment of the application, the limiting pressure ring is fixedly connected with the front flange of the motor through a first screw.

In one exemplary embodiment of the application, a set screw pointing to the surface of the rotating shaft of the motor is provided on the impeller and the impeller is a toothed structure impeller.

In one exemplary embodiment of the application, a sealing gasket is provided between the cover plate and the pump body.

In one exemplary embodiment of the application, an O-ring gasket is provided between the pump body flange and the pump body.

In one exemplary embodiment of the application, the cover plate is fixed on the pump body through a second screw or by means of hot-melt welding.

In one exemplary embodiment of the application, a third screw connected with the pump body flange is provided on the pump body, and a fourth screw penetrating through the pump body flange and connected with the front flange of the motor is further provided on the pump body.

In one exemplary embodiment of the application, a handle is further provided on the pump body flange.

The application has the following beneficial effects: since the multipurpose transfer pump free of secondary water filling disclosed by the application is particularly designed with the water suction cavity and the water inlet pipe joint which extend obliquely and upwardly, after the motor is powered off, the water in the pump body flows back into the water suction cavity and the water inlet pipe joint; when the level of the water in the pump body returns to the volute tongue part, air enters the water suction cavity, the water no longer flows back and the siphon effect is lost; since the water suction cavity and the water inlet pipe joint are provided obliquely and upwardly, part of the water in the water suction cavity and the water inlet pipe joint flows downwards to the volute chamber due to gravity, and the impeller is submerged; when the motor works for a second time, a self-priming effect can be achieved without filling water into the pump body, such that the convenience in operation is greatly improved, the impeller lubricating effect is good and the service life is long.

DESCRIPTION OF THE DRAWINGS

In order to more clearly describe the technical solution in the embodiment of the application, the drawings which need be used in the description of the embodiment will be briefly introduced below. Apparently, the drawings described below are just some embodiments of the application. Those skilled in the art may obtain other drawings according to these drawings without contributing any inventive labor.

DESCRIPTION OF THE EMBODIMENTS

The technical solution in the embodiment of the application will be described below clearly and completely. Apparently, the described embodiments are partial embodiments of the application, instead of all embodiments. Based on the embodiments of the application, all other embodiments obtained by those skilled in the art without contributing any inventive labor shall fall into the scope of protection of the application.

Figure 1:
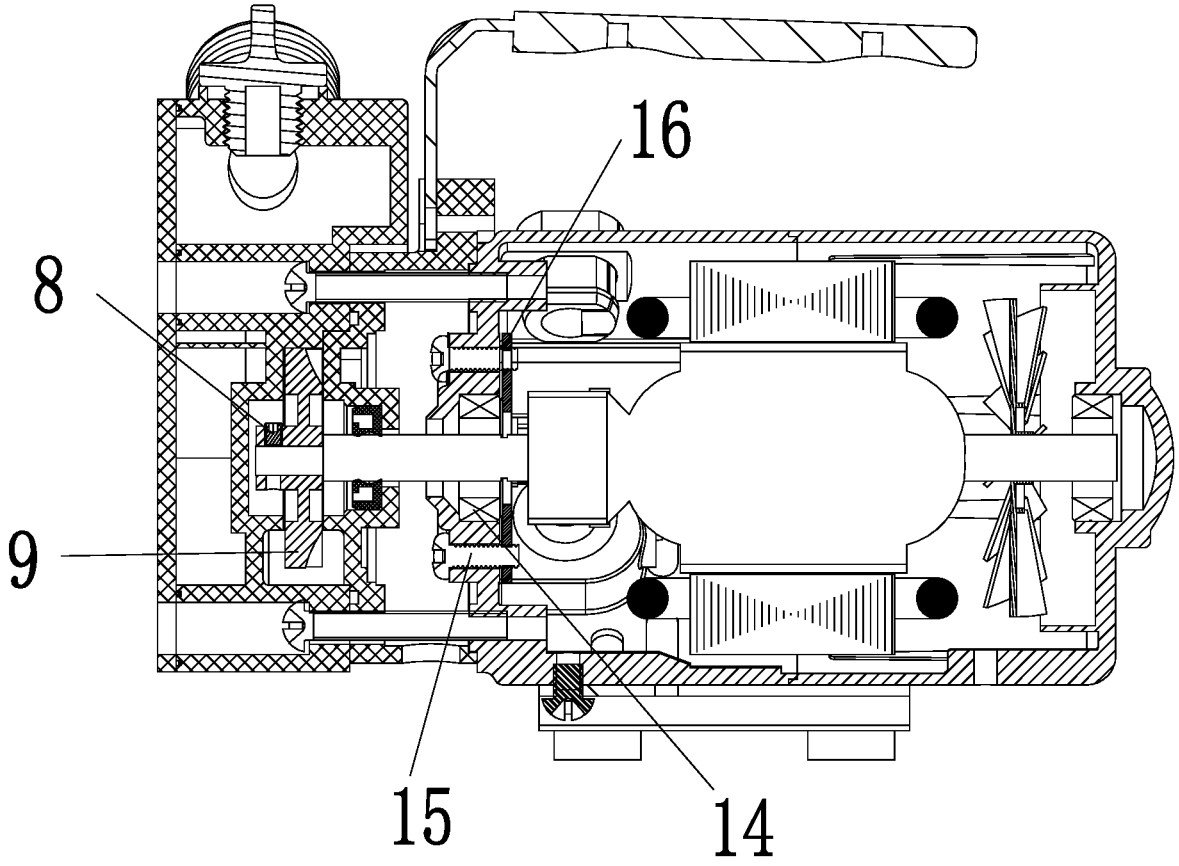
FIG. 1 is a structural schematic view of a multipurpose transfer pump free of secondary water filling according to one exemplary embodiment of the application.
Figure 2:
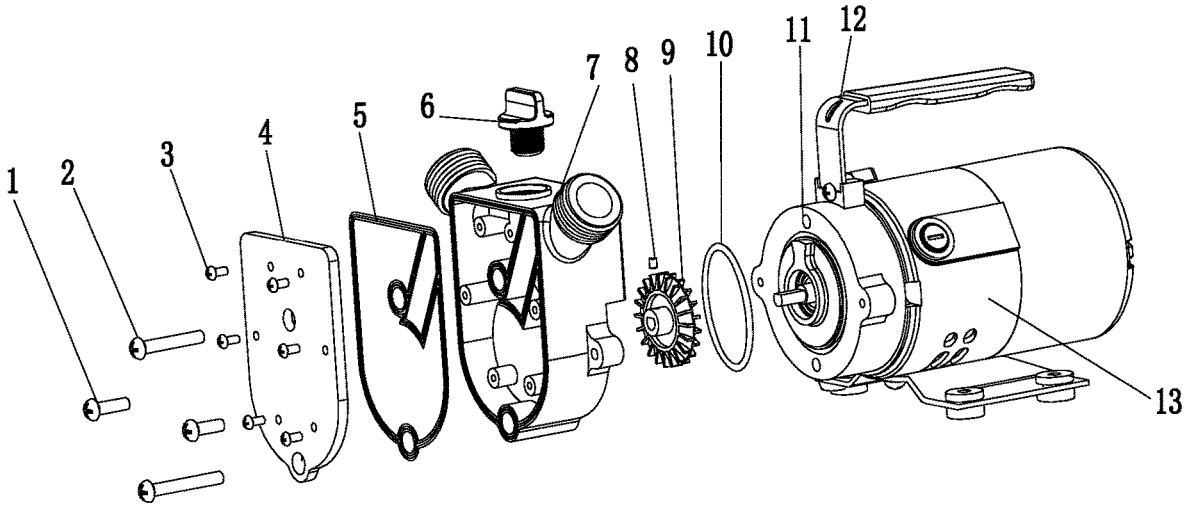
FIG. 2 is an exploded view of FIG. 1.
Figure 3:
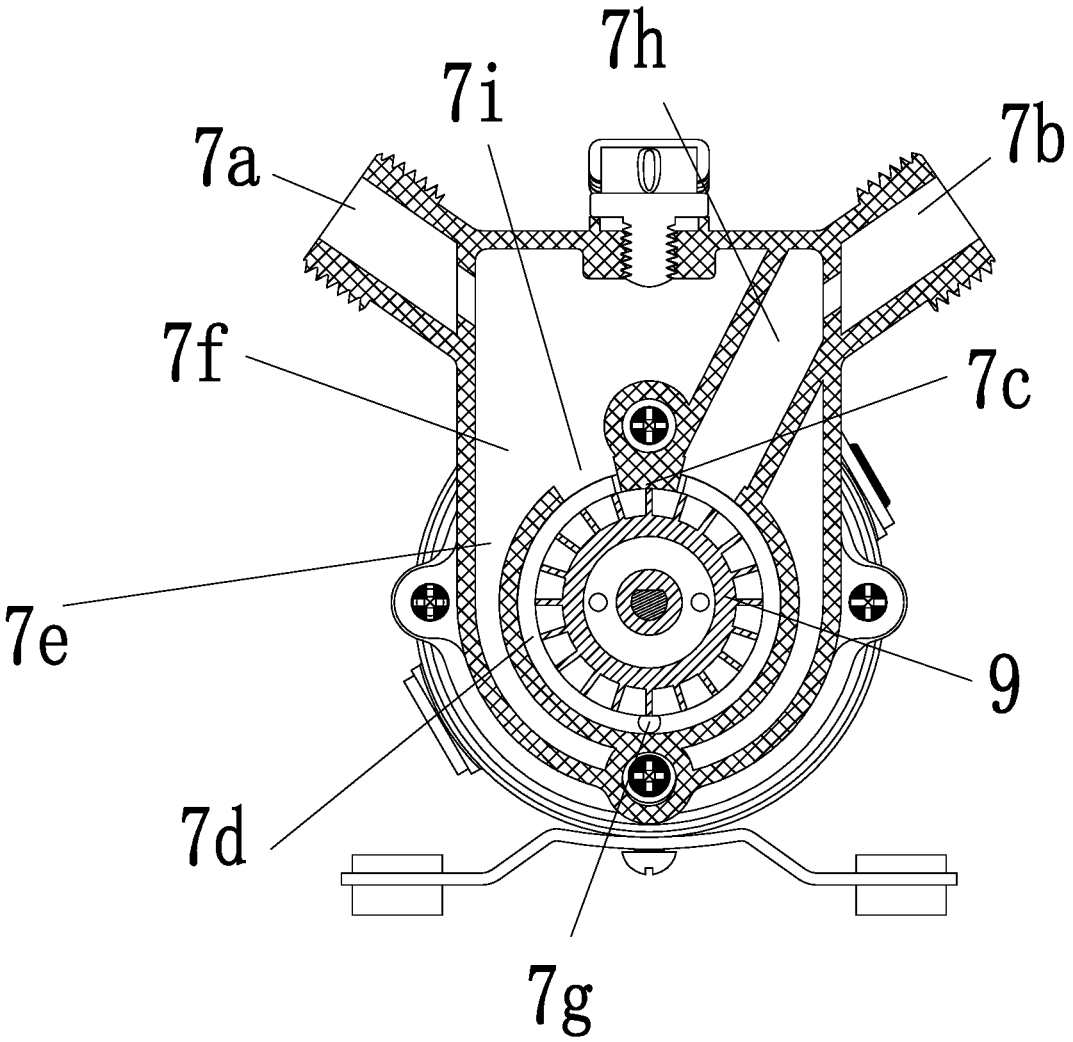
FIG. 3 is a sectional view of a pump body flange in FIG. 2.

Please refer to FIG. 1-FIG. 3. The embodiment of the application is as follows:

Referring to FIG. 1 and FIG. 2, a multipurpose transfer pump free of secondary water filling includes a cover plate 4, a water filling plug 6, a pump body 7, an impeller 9, a pump body flange 11 and a motor 13, the pump body flange 11 is provided at an end portion of the motor 13, the pump body 7 is provided on a front surface of the pump body flange 11, a third screw 1 connected with the pump body flange 11 is provided on the pump body 7, the structure is firm, and an O-ring gasket 10 is provided between the pump body flange 11 and the pump body 7 to guarantee the sealing performance at the connection.

A fourth screw 2 penetrating through the pump body flange 11 and connected with the front flange of the motor 13 is further provided on the pump body 7, which realizes the fixation of the pump body flange 11 at the end portion of the motor 13, such that it is convenient to mount and dismount. A handle 12 is provided on the pump body flange 11, such that the portability is good.

A volute chamber 7*d* corresponding to the impeller 9 is provided in a back surface of the pump body 7 in an inwards recessed manner, the impeller 9 is provided in the volute chamber 7*d* and is concentrically fixed on a rotating shaft of the motor 13, a set screw 8 pointing to the surface of the rotating shaft of the motor 13 is provided on the impeller 9 to realize the axial adjustment and fixation of the impeller 9, and a corresponding threaded hole corresponding to the set screw 8 is provided on the impeller 9, such that it is convenient to mount. Moreover, the cross section of the end portion of the rotating shaft of the motor 13 may be D-shaped, so a mounting hole in the impeller 9 is configured as a D-shaped mounting hole to avoid the relative torsion between the impeller 9 and the rotating shaft and to improve the structural stability. In addition, the impeller 9 adopts a toothed structure, several staggered blades are provided on the front and back surfaces of the impeller 9, and symmetrical balance holes are provided in the middle and are used to offset the pressure difference between the front and back surfaces of the impeller 9, such that the operation is more stable.

Referring to FIG. 1, a bearing mounting groove is provided in the front flange of the motor 13, a front bearing 14 which is provided on the rotating shaft of the motor in a sleeving manner is provided in the bearing mounting groove, a limiting pressure ring 16 is provided behind the front bearing 14, the limiting pressure ring 16 is fixedly connected with the front flange of the motor through a first screw 15 to limit the position of the front bearing 14, the inner ring of the front bearing 14 is in interference fit with the rotating shaft of the motor, and the axial limiting of the rotating shaft is realized through the front bearing 14, such that the axial stability of the impeller 9 is improved, the small clearance between the two sides of the impeller 9 and the pump body 7 and the pump body flange 11 is guaranteed, the clearance is controlled in the range of 0.1-0.25 mm, the friction between the impeller 9 and the pump body 7 and the pump body flange 11 is avoided, and thus the stalling problem of the motor 13 is avoided.

Referring to FIG. 3, a water inlet pipe joint 7*b* and a water outlet pipe joint 7*a* which extend obliquely and upwardly towards outer sides are provided on the two sides of a top of the pump body 7, and the water inlet pipe joint 7*b* and the water outlet pipe joint 7*a* are distributed in a V-shaped angle to facilitate connection with a water inlet pipeline and a water outlet pipeline.

A liquid storage chamber 7*e* enclosing the volute chamber 7*d* and a gas-liquid separation chamber 7*f* located above the liquid storage chamber 7*e* are provided in a front surface of the pump body 7 in an inwards recessed manner, two partition plates which extend obliquely and upwardly are provided in the gas-liquid separation chamber 7*f* to form a water suction cavity 7*h* communicated with the water inlet pipe joint 7*b* and the volute chamber 7*d*, a drainage outlet 7*i* communicated with the gas-liquid separation chamber 7*f* is provided in the volute chamber 7*d*, a volute tongue part 7*c* tangent to the impeller 9 is provided at a top of the volute chamber 7*d*, and the drainage outlet 7*i* and the water suction cavity 7*h* are located on the two sides of the volute tongue part. When the impeller 9 rotates, the gas in the water suction cavity 7*h* and the water in the volute chamber 7*d* are stirred together, and the water flow is blocked by the volute tongue part 7*c*, such that the water flows into the gas-liquid separation chamber 7*f*, the gas in the water is discharged, and a certain vacuum degree is formed in the water suction cavity 7*h* to complete self-priming water pumping.

Referring to FIG. 3, the cover plate 4 is provided on the front surface of the pump body 7 to seal the liquid storage chamber 7*e*, the gas-liquid separation chamber 7*f* and the water suction cavity 7*h*, and a sealing gasket 5 is provided between the cover plate 4 and the pump body 7, such that the sealing effect of the liquid storage chamber 7*e*, the gas-liquid separation chamber 7*f* and the water suction cavity 7*h* is ensured through the sealing gasket 5. The cover plate 4 is fixed on the pump body 7 through a second screw 3 or by means of hot-melt welding. The cover plate 4, the sealing gasket 5 and the pump body 7 may all be made of plastic parts, such that the dead weight is light and the problem of corrosion is avoided. Moreover, assembling may be realized by adopting hot-melt welding, such that the structure is stable.

The water filling plug 6 is mounted on the pump body 7 in a threaded manner. When the pump works for a first time, firstly the water filling plug 6 is opened to fill water into the liquid storage chamber 7*e*, and then the water filling plug 6 is mounted for sealing. The bottom of the volute chamber 7*d* is provided with a backflow hole 7*g* communicated with the liquid storage chamber 7*e*, and the water in the liquid storage chamber 7*e* enters the volute chamber 7*d* from the backflow hole 7*g* such that it can be mixed with the gas inhaled. After the work is finished, the water in the pump body 7 enters the water suction cavity 7*h* under the siphon effect. When the level of the water in the pump body 7 drops to the volute tongue part 7*c*, air enters the water suction cavity 7*h*, the water no longer flows back, and the siphon effect is lost. Since the water suction cavity 7*h* and the water inlet pipe joint 7*b* are provided obliquely and upwardly, part of the water in the water suction cavity 7*h* and the water inlet pipe joint 7*b* flows downwards to the volute chamber 7*d* due to gravity, and the impeller 9 is submerged to facilitate subsequent secondary water pumping.

To sum up, by adopting the multipurpose transfer pump free of secondary water filling disclosed by the application, as long as a certain volume of water is filled into the volute chamber 7*d* for the first time, no water needs to be filled for subsequent water pumping, the operation is convenient to perform, the axial structure of the impeller 9 is stable, the impeller lubricating effect is good and the problem of friction is avoided.

What are described above are just exemplary embodiments of the application, which are not used to limit the scope of protection of the application. Any transformation of equivalent structure or equivalent process made by using the contents of the description of the application, or directly or indirectly applied to other related technical fields, is similarly included in the scope of protection of the application.

The invention claimed is:

1. A multipurpose transfer pump free of secondary water filling, wherein the multipurpose transfer pump free of secondary water filling comprises a cover plate, a water filling plug, a pump body, an impeller, a pump body flange and a motor, the pump body flange is provided at an end portion of the motor, the pump body is provided on a front surface of the pump body flange, a volute chamber corresponding to the impeller is provided in a back surface of the pump body in an inwards recessed manner, the impeller is provided in the volute chamber and is concentrically fixed on a rotating shaft of the motor, a volute tongue part tangent to the impeller is provided at a top of the volute chamber, a liquid storage chamber enclosing the volute chamber and a gas-liquid separation chamber located above the liquid storage chamber are provided in a front surface of the pump body in an inwards recessed manner, a water inlet pipe joint and a water outlet pipe joint which extend obliquely and upwardly towards outer sides are provided on two sides of a top of the pump body, two partition plates are provided in the gas-liquid separation chamber to form a water suction cavity communicated with the water inlet pipe joint and the volute chamber, a drainage outlet communicated with the gas-liquid separation chamber is provided in the volute chamber, the drainage outlet and the water suction cavity are located on the two sides of the volute tongue part, the cover plate is provided on the front surface of the pump body to seal the liquid storage chamber, the gas-liquid separation chamber and the water suction cavity, and the water filling plug is mounted on the pump body in a threaded manner;

wherein a bearing mounting groove is provided in a front flange of the motor, a front bearing which is provided on the rotating shaft of the motor in a sleeving manner is provided in the bearing mounting groove, and a limiting pressure ring is provided behind the front bearing.

2. The multipurpose transfer pump free of secondary water filling according to claim 1, wherein the water inlet pipe joint and the water outlet pipe joint are distributed in a V-shaped angle.

3. The multipurpose transfer pump free of secondary water filling according to claim 1, wherein the limiting pressure ring is fixedly connected with the front flange of the motor through a first screw.

4. The multipurpose transfer pump free of secondary water filling according to claim 1, wherein a sealing gasket is provided between the cover plate and the pump body.

5. The multipurpose transfer pump free of secondary water filling according to claim 1, wherein an O-ring gasket is provided between the pump body flange and the pump body.

6. The multipurpose transfer pump free of secondary water filling according to claim 1, wherein the cover plate is fixed on the pump body through a second screw or by means of hot-melt welding.

7. The multipurpose transfer pump free of secondary water filling according to claim 1, wherein a handle is further provided on the pump body flange.

8. A multipurpose transfer pump free of secondary water filling, wherein the multipurpose transfer pump free of secondary water filling comprises a cover plate, a water filling plug, a pump body, an impeller, a pump body flange and a motor, the pump body flange is provided at an end portion of the motor, the pump body is provided on a front surface of the pump body flange, a volute chamber corresponding to the impeller is provided in a back surface of the pump body in an inwards recessed manner, the impeller is provided in the volute chamber and is concentrically fixed on a rotating shaft of the motor, a volute tongue part tangent to the impeller is provided at a top of the volute chamber, a liquid storage chamber enclosing the volute chamber and a gas-liquid separation chamber located above the liquid storage chamber are provided in a front surface of the pump body in an inwards recessed manner, a water inlet pipe joint and a water outlet pipe joint which extend obliquely and upwardly towards outer sides are provided on two sides of a top of the pump body, two partition plates are provided in the gas-liquid separation chamber to form a water suction cavity communicated with the water inlet pipe joint and the volute chamber, a drainage outlet communicated with the gas-liquid separation chamber is provided in the volute chamber, the drainage outlet and the water suction cavity are located on the two sides of the volute tongue part, the cover plate is provided on the front surface of the pump body to seal the liquid storage chamber, the gas-liquid separation chamber and the water suction cavity, and the water filling plug is mounted on the pump body in a threaded manner, wherein a set screw pointing to the surface of the rotating shaft of the motor is provided on the impeller and the impeller is a toothed structure impeller.

9. A multipurpose transfer pump free of secondary water filling, wherein the multipurpose transfer pump free of secondary water filling comprises a cover plate, a water filling plug, a pump body, an impeller, a pump body flange and a motor, the pump body flange is provided at an end portion of the motor, the pump body is provided on a front surface of the pump body flange, a volute chamber corresponding to the impeller is provided in a back surface of the pump body in an inwards recessed manner, the impeller is provided in the volute chamber and is concentrically fixed on a rotating shaft of the motor, a volute tongue part tangent to the impeller is provided at a top of the volute chamber, a liquid storage chamber enclosing the volute chamber and a gas-liquid separation chamber located above the liquid storage chamber are provided in a front surface of the pump body in an inwards recessed manner, a water inlet pipe joint and a water outlet pipe joint which extend obliquely and upwardly towards outer sides are provided on two sides of a top of the pump body, two partition plates are provided in the gas-liquid separation chamber to form a water suction cavity communicated with the water inlet pipe joint and the volute chamber, a drainage outlet communicated with the gas-liquid separation chamber is provided in the volute chamber, the drainage outlet and the water suction cavity are located on the two sides of the volute tongue part, the cover plate is provided on the front surface of the pump body to seal the liquid storage chamber, the gas-liquid separation chamber and the water suction cavity, and the water filling plug is mounted on the pump body in a threaded manner, wherein a third screw connected with the pump body flange is provided on the pump body, and a fourth screw penetrating through the pump body flange and connected with a front flange of the motor is further provided on the pump body.

* * * * *